United States Patent [19]

Bardsley et al.

[11] Patent Number: 4,712,846

[45] Date of Patent: Dec. 15, 1987

[54] CONNECTOR APPARATUS

[75] Inventors: Frank B. Bardsley, Andover; Alec B. Sycha, Wokingham, both of United Kingdom

[73] Assignee: Gearhart Tesel Limited, Basin Gstoke, England

[21] Appl. No.: 775,740

[22] Filed: Sep. 12, 1985

[30] Foreign Application Priority Data

Sep. 14, 1984 [GB] United Kingdom ..... 8423300

[51] Int. Cl.[4] ..... H01R 13/518

[52] U.S. Cl. ..... 439/33; 439/294; 439/724

[58] Field of Search ..... 175/321; 339/49 R, 89 R, 339/89 M, 90 R, 91 R, 124, 136 R, 136 M, 2 R

[56] References Cited

U.S. PATENT DOCUMENTS

| | | | |
|---|---|---|---|
| 1,480,357 | 1/1924 | Wilson | 175/321 |
| 2,740,098 | 3/1956 | Phillips | 339/89 R |
| 2,779,008 | 1/1957 | Quackenbush | 339/89 M |
| 2,824,290 | 2/1958 | Archer et al. | 339/49 R |
| 3,587,757 | 6/1971 | Herring | 175/321 |
| 3,721,939 | 3/1973 | Paugh | 339/91 R |
| 3,789,346 | 1/1974 | De Brick | 339/89 R |
| 4,261,628 | 4/1981 | Gallagher et al. | 339/91 R |
| 4,302,066 | 11/1981 | Newman et al. | 339/75 R |

*Primary Examiner*—John McQuade

*Attorney, Agent, or Firm*—Hubbard, Thurman, Turner & Tucker

[57] ABSTRACT

A connector is provided for making electrical connection between electrical conductors in a first connector casing and electrical conductors in a second connector casing. The first and second connector casings are mutually engageale in one orientation only by relative axial movement. The connector has a first connector assembly (10) at one end thereof and a second connector assembly at the other end thereof, the connector assemblies being engageable with corresponding connector assemblies in other tool bodies. The connector assemblies each have a connector body (11) and a support ring (15) and pins (22, 23, 25) for preventing relative axial and rotational movement between the ring (15) and the connector casing (20), the pins (22, 23 and 25) making no direct engagement with the connector assemblies.

14 Claims, 5 Drawing Figures

CONNECTOR APPARATUS

BACKGROUND OF THE INVENTION

1. Field of the Invention

The invention relates to connectors for allowing electrical connection to be made between two sets of conductors.

2. Description of Related Information

In the field of borehole logging, it is necessary to relay electrical signals from sensing devices back to the surface for analysis. The sensing devices used need to be cased robustly to survive the hostile conditions downhole and there have been difficulties in providing consistently accurate electrical connectors to provide external electrical connections for the sensing devices. Often, in connectors used hitherto, when connector alignment has been inaccurate, total connector failure has been caused when the outer case has been connected to, for example, another tool or a wireline.

SUMMARY OF THE INVENTION

According to the invention there is provided a connector for making electrical connection between electrical conductors in a first connector casing and electrical conductors in a second connector casing, the first and second connector casings being mutually engageable in one orientation only by relative axial movement, which connector comprises a first connector assembly located in the first connector casing and a second connector assembly located in the second connector casing, the first and second connector assemblies comprising respectively first and second connector bodies matable one with another by relative axial movement in a single rotational orientation only, first and second rigid support means engaging the first and second connector assemblies respectively to prevent relative rotation between the associated connector assembly and rigid support means, and means locating the first and second rigid support means in the first and second connector casings respectively to prevent relative axial and rotational movement therebetween, the arrangement being such that the locating means make no direct engagement with the connector assemblies.

Each rigid support means may comprise a ring surrounding the respective connector assembly.

Each connector assembly may include a body having one or more outwardly extending engagement portions, each ring including part cylindrical flange means engaging the engagement portion or portions of the respective body.

The locating means may comprise at least one peripheral, tangential slot and at least one pin engaging the respective connector casing and said slot. There are preferably two pins, and four slots, adjacent slots lying perpendicular to one another.

The locating means may further comprise a radially movable pin engaging a bold in the associated connector casing and said part cylindrical flange means. The flange means may comprise a pair of opposed part cylindrical flanges, one flange being divided axially by a space engageable by said radially engageable pin.

Means are preferably provided for sealing each connector assembly in the respective connector casing. The sealing means may comprise one or more O-rings.

One or both of the connector casings may comprise means for holding the casing in a predetermined orientation in a tool body. The holding means may comprise a resiliently biased plug engageable in use in recess in the tool body. The plug may comprise a chamfered edge for allowing the plug to be raised from the recess, in use, to allow removal of the connector casing from the tool body. The tool body may include a chassis including two connector casings and associated connector assemblies. Means are preferably provided for allowing relative axial movement between the two connector assemblies, to allow, for example, for temperature caused expansion and contraction. The means preferably comprise sliding means, preferably including a pin and slot engagement arrangement.

BRIEF DESCRIPTION OF THE DRAWINGS

By way of example, embodiments of a connector according to the invention will now be described with reference to the accompanying drawings, in which.

DETAILED DESCRIPTION OF THE PREFERRED EMBODIMENT

Figure 1:
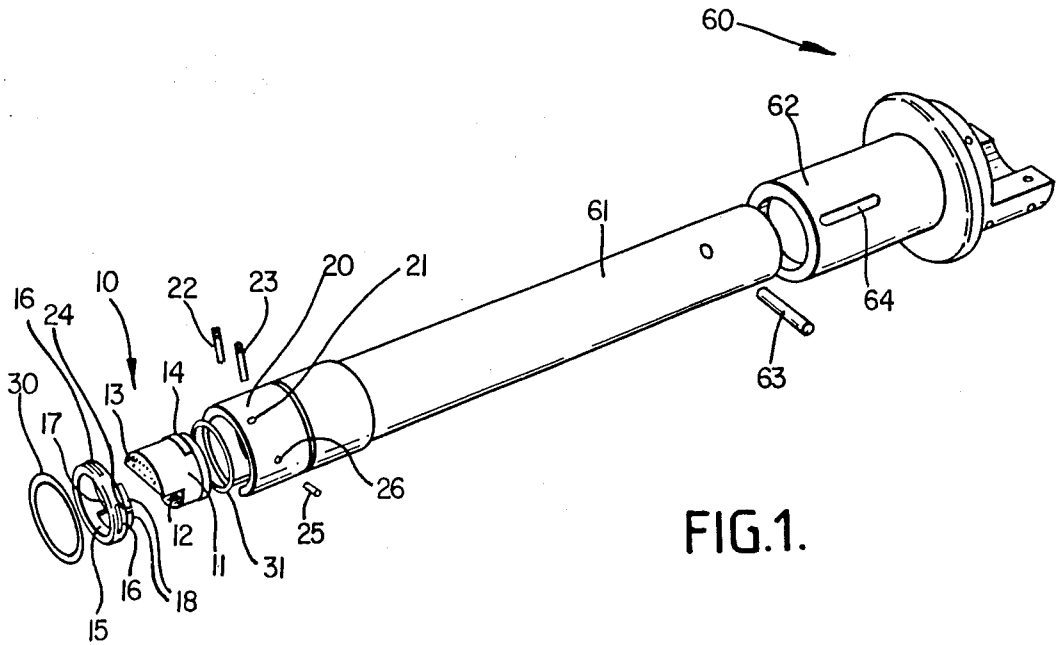
FIG. 1 is an exploded view of part of a connector according to the invention.

FIG. 1 shows a multi-pin connector assembly 10 which has a moulded body 11 supporting a multiplicity of male connector pins 12 and female connector sockets 13. The body 11 is of a plastics material.

The body 11 is formed with an outwardly extending engagement portion 14 which may be moulded or machined.

A rigid metal support ring 15 has an internal diameter to fit snugly over the body 11. The ring has four tangential slots 16 formed in its periphery, slots 16 are oriented 90 degrees from one another, and a pair of part cylindrical locating flanges 17, 18, which flanges 17, 18 engage the sides of the engagement portion 14 of the body 11 to prevent any relative rotation between the body 11 and the ring 15, and accurately orientate the body 11 and the ring 15.

In use, the connector assembly 10 and the ring 15 lie within a connector casing 20 formed with a pair of holes 21 having parallel axes on either side of the longitudinal axis of the connector assembly 10. In FIG. 1, one hole 21 is visible. The longitudinal axes of the holes 21 lie tangential to a circle centered on the longitudinal axis of the casing 20. Pins 22, 23 engage the holes 21 and also engage two of the slots 16 to locate the ring 15 axially and radially relative to the casing 20.

In addition, the flange 18 is split centrally to provide a gap 24 between the two flange parts, and a radially movable pin 25 is engageable in a hole 26 in the casing 20 and between the parts of the flange 18 in the gap 24.

O-ring 31 provide a fluid-tight seal between the body 11 and the casing 20.

The casing 20 is mounted on a tool chassis generally indicated at 60. The chassis carries a casing 20 and associated connector assembly at each end thereof so that a series of tools can be electrically connected together. In order to allow for expansion and contraction of the distance between the connector assemblies in use, due to temperature fluctuation, an axial sliding arrangement is provided between mating tubular elements 61, 62. Correct rotational alignment is assured by a pin 63 engaging the element 61 and also engaging a slot 64 in the element 62.

Figure 2:
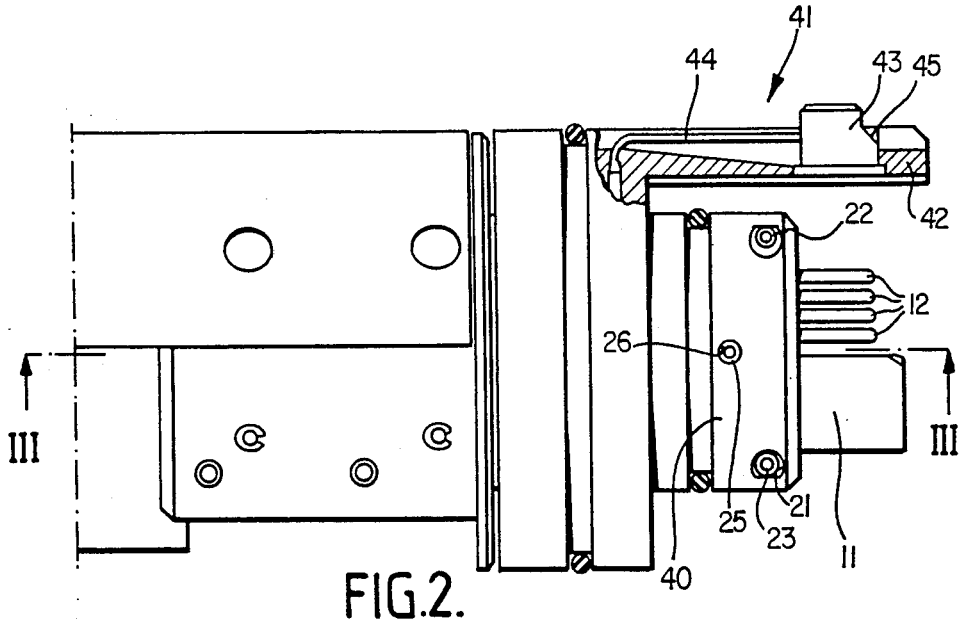
FIG. 2 is a side view of part of a connector according to the invention.

FIG. 2 shows a side view of a connector in a different casing 40 and clearly shows the body 11, male pins 12, tangential locating pins 22, 23 and radially movable pin 25. The casing 40 carries a holding assembly 41 for holding the casing 40 in a tool body (not shown). The holding assembly has a rigid cantilever 42 having a hole through which a plug 43 is movable and against which cantilever the plug 43 seats, the plug being supported on and resiliently biased by a resilient arm 44. In use, when insertion into a tool body takes place, the plug is urged towards the connector body 11 as it travels through the body, and when in the correct position, the plug 43 engages a preformed recess in the interior wall of the tool body. In order to withdraw the casing 40, a retractor tool (not shown) is needed, the retractor tool having a tongue which engages a chamfered edge 45 of the plug 43 to force the plug towards the connector body 11.

Figure 3:
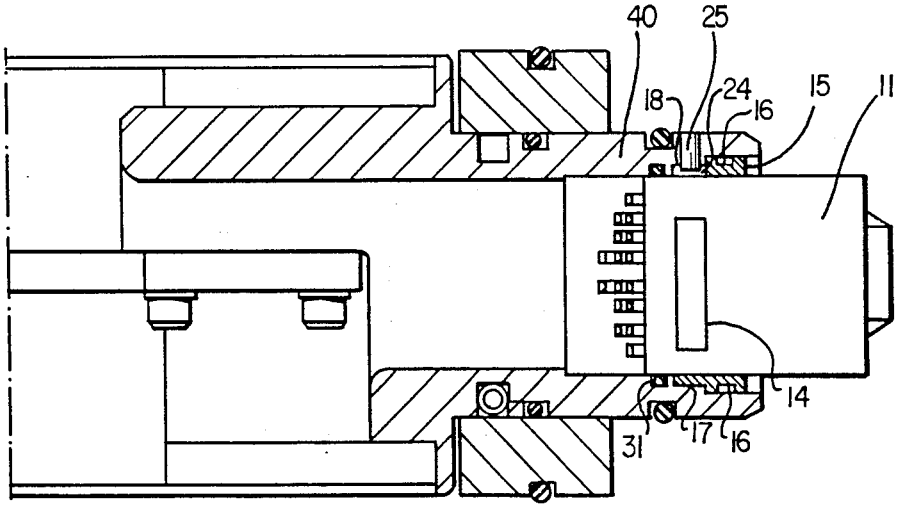
FIG. 3 is a sectional view along the lines III—III in FIG. 2.

FIG. 3 is a sectional view along the lines III—III in FIG. 2, and shows the ring 15 and the engagement portion of the radially movable pin 25.

Other details of the chassis on which the connector casing 40 is mounted are not part of this invention and will not be described.

Figure 5:
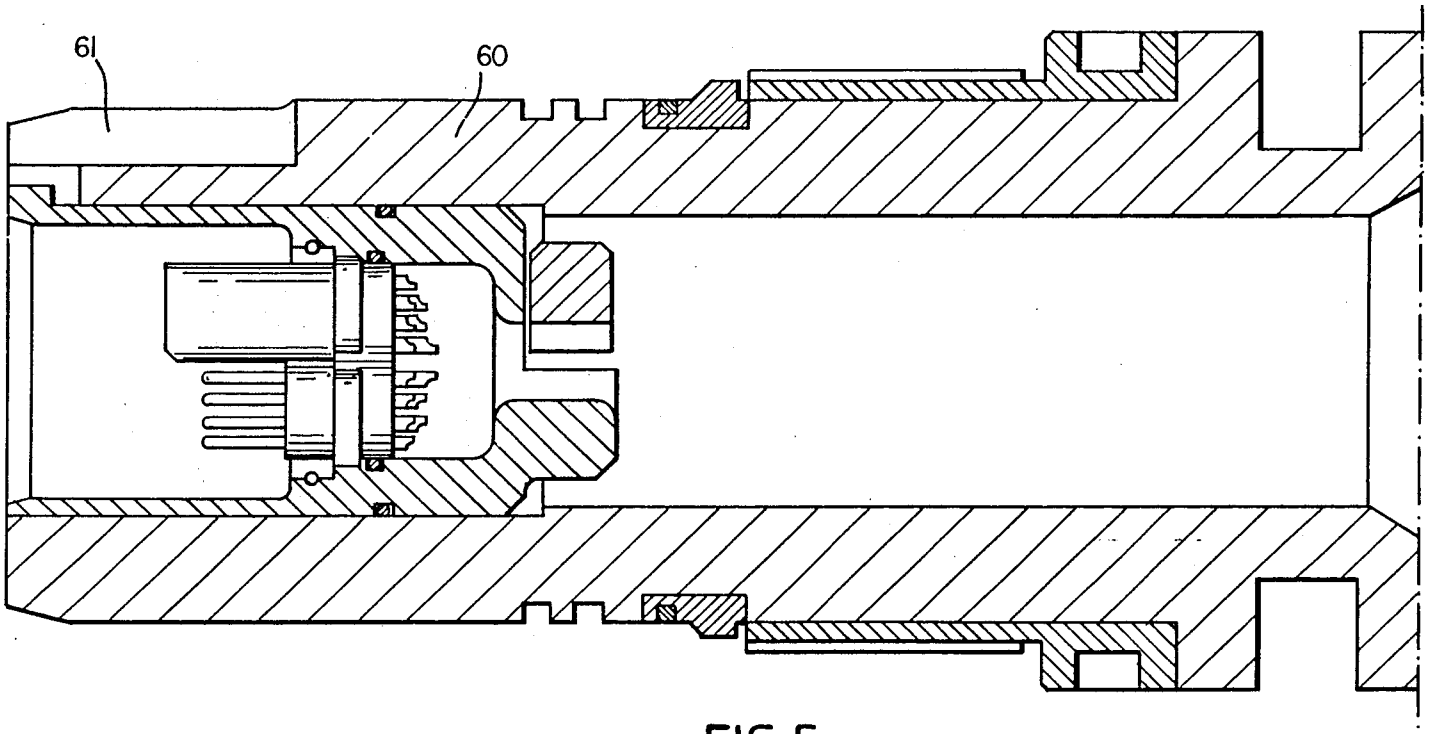
FIG. 5 is a view illustrating a connector assembly in a connector casing in a tool body.

In use, the casing 40 with the holding assembly when mounted in a tool body is engaged by a particular shape of tool or wireline end connection, shown in FIG. 5. The tool or wireline end 60 (shown holding a connector not in accordance with this invention) has an outer profile including a groove 61 engaged by the cantilever 42 of the holding assembly 41. This arrangement ensures correct rotational alignment of the mating parts and, via the connector casings, rings 15 and connector assemblies 10, correct alignment of the connector pins and sockets 13.

Figure 4:
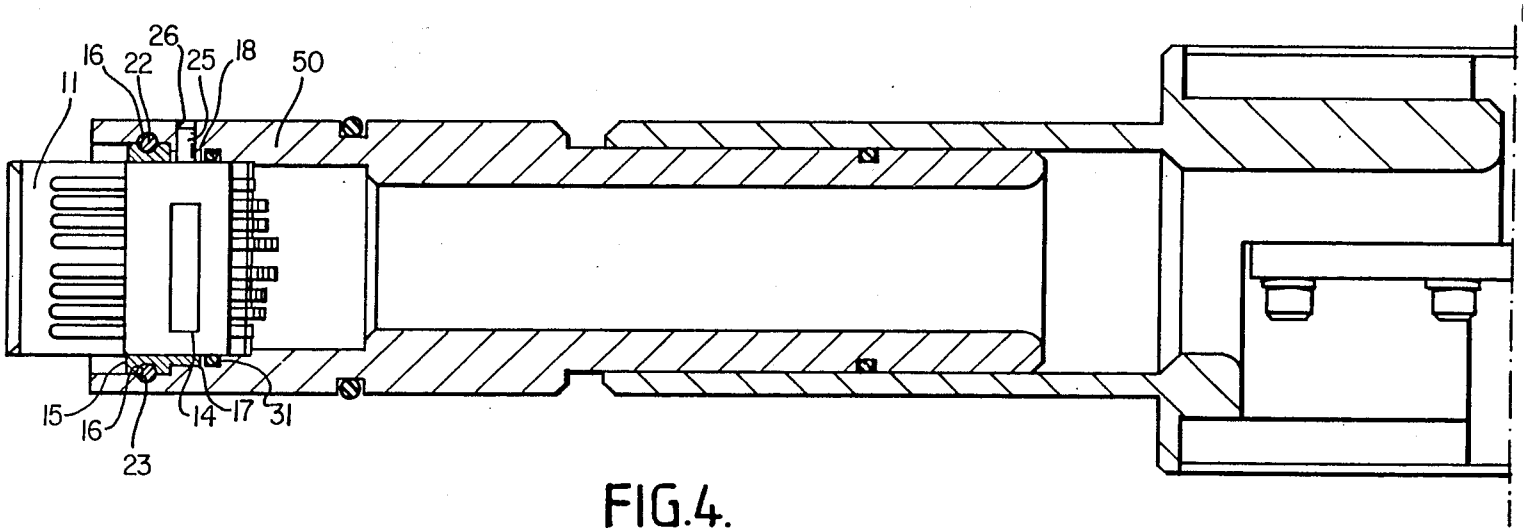
FIG. 4 is a sectional view of a connector according to the invention in a different embodiment of connector casing.

FIG. 4 is a sectional view of connector in a further embodiment of a connector casing 50. In this embodiment, the tangential pins 22, 23 lie perpendicular to the radially movable pin 25, but otherwise mounting of the connector assembly 10 in the casing 50 is similar to the embodiments previously described.

It will be appreciated that in all the embodiments of connector casing decribed, the casing itself provides a stop against sliding of the body 11 with the casing.

The advantage of these embodiments of a connector according to the invention is that the connector body is aligned first with the surrounding ring, loads applied to the connector body being transferred to the rigid ring by an integral, robust portion of the connector body 11, and that positive orientation and location of the connector body are achieved by pin engagement with the ring and casing only, not the connector body itself.

What is claimed is:

1. A connector for making electrical connection between electrical conductors in a first connector casing and electrical conductors in a second connector casing, the first and second connector casings being mutually engageable in one orientation only by relative axial movement, which connector comprises a first connector assembly located in the first connector casing and a second connector assembly located in the second connector casing, the first and second connector assemblies comprising respectively first and second connector bodies matable one with another by relative axial movement in a single rotational orientation only, first and second rigid support means engaging the first and second connector assemblies respectively, each of said rigid support means including a ring surrounding the respective connector assembly wherein each of said connector assemblies includes at least one outwardly extending engagement portion and each ring includes part-cylindrical flange means for engaging said at least one engagement portion of the respective body to prevent relative rotation between the associated connector assembly and the rigid support means, and means locating the first and second rigid support means in the first and second connector casings respectively to prevent relative axial and rotational movement therebetween, the arrangement being such that the locating means make no direct engagement with the connector assemblies.

2. A connector as claimed in claim 1 wherein the locating means includes a radially movable pin engaging a hole in the associated connector casing and said part-cylindrical flange means.

3. A connector as claimed in claim 2 wherein the flange means comprise a pair of opposed part-cylindrical flanges, one flange being divided axially by a space engageable by said radially engageable pin.

4. A connector as claimed in claim 1 wherein the locating means comprise at least one peripheral, tangential slot in said rigid support means and at least one pin engaging the respective connector casing and said slot.

5. A connector as claimed in claim 4 comprising two pins and four said slots, said slots being situated 90 degrees from one another.

6. A connector as claimed in claim 1 comprising means for sealing each connector assembly in the respective connector casing.

7. A connector as claimed in claim 6 wherein the sealing means comprise at least one O-ring.

8. A connector as claimed in claim 1 wherein at least one of the connector casings comprise means for holding the casing in a predetermined orientation in a tool body.

9. A connector as claimed in claim 8 wherein the holding means comprise a resiliently biased plug engageable in use in a recess in the tool body.

10. A connector as claimed in claim 9 wherein the plug has a chamfered edge for allowing the plug to be raised from the recess, in use, to allow removal of the connector casing from the tool body.

11. A connector as claimed in claim 1 including a chassis carrying at least one of said connector assemblies.

12. A connector as claimed in claim 11 comprising means for allowing relative axial movement between said chassis and said at least one connector assemblies.

13. A connector as claimed in claim 12 wherein the axial movement allowing means comprising sliding means.

14. A connector as claimed in claim 13 wherein the sliding means includes a pin and slot engagement arrangement.

* * * * *